United States Patent [19]

Inoue

[11] 3,958,489

[45] May 25, 1976

[54] MACHINE FOR USE IN MAKING TOY SPARKLERS

[75] Inventor: Katuhiko Inoue, Shimada, Japan

[73] Assignee: Inoue Toy-Fireworks Company Limited, Shimadi, Japan

[22] Filed: Mar. 3, 1975

[21] Appl. No.: 554,732

[30] Foreign Application Priority Data

Mar. 9, 1974 Japan ..... 49-27477

[52] U.S. Cl. ..... 86/20 V; 86/20 R; 221/200

[51] Int. Cl.[2] ..... C06B 21/00; F42B 4/20

[58] Field of Search ..... 86/20 R, 20 V; 102/37.52, 37.8; 221/93, 200, 204

[56] References Cited

UNITED STATES PATENTS

| | | | |
|---|---|---|---|
| 469,992 | 3/1892 | Cox | 86/20 V |
| 639,383 | 12/1899 | Harris | 221/93 |
| 1,618,627 | 2/1927 | Backstrom | 221/93 X |
| 2,313,500 | 3/1943 | Anderson | 221/93 X |
| 2,645,398 | 7/1953 | Anderson | 221/93 X |

FOREIGN PATENTS OR APPLICATIONS

| | | | |
|---|---|---|---|
| 247,437 | 7/1911 | Germany | 102/37.52 |

*Primary Examiner*—Edward A. Miller
*Attorney, Agent, or Firm*—Frank J. Jordan

[57] ABSTRACT

A machine for making fireworks such as sparklers and the like includes a casing disposed over a tabletop and wherein means are provided to effect vibration of sparkler sticks in the casing. A plurality of depressions in the tabletop have a central opening through which individual sparkler sticks pass. A raised edge is provided around the central opening to facilitate processing the sparkler sticks through the openings. A receiving plate and insertion plate are located below the tabletop to receive the sparkler sticks after they have passed through the openings in the tabletop.

7 Claims, 6 Drawing Figures

MACHINE FOR USE IN MAKING TOY SPARKLERS

BACKGROUND OF THE INVENTION

This invention relates to a machine for making toy-fireworks such as sparklers and the like.

Conventional machines for making toy-fireworks such as sparklers and the like and used for facilitating the production of sparklers while reducing the amount of manual operation of having to place sticks of bamboo, wood, or wire between a pair of bamboo spatulas, have had various drawbacks. For example, the simply horizontal motion of the stick supporting means results in disadvantages as regards the working efficiency due to the improper insertion of the sticks in the inserting plate which occurs when the sticks fall simultaneously and the sticks obstruct the holes regularly provided at the bottom of the stick charging casing with the insertion of two or more sticks at one time in the same hole. As a result of the obstruction of the standing sticks in the inserting plate against the machine members, it is difficult to remove the plate from the machine and the manual and pedal operation of the stick receiving plate repeatedly ascending and descending, rapidly tires the operator.

The machine according to the present invention comprises a stick charging casing having a bottom which defines the table of the machine, and which is arranged with multiple circular depressions at regular intervals. The circular depressions have a single hole as the center thereof and the edge around the hole rises slightly higher than the bottom of the depression. A framed net has an extending shank at both sides with one shank being supported by a coil spring surrounding a vertical rod and the other shank by a roller on a shaft rotating eccentrically within a link of a lever. The arrangement is such as to impart shocks or vibrations in multiple directions to the upper part of the sticks carried in subdivided sections in the casing. A plate disposed beneath the sticks ascends and descends under the casing by means of an air cylinder operated by a pedal.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

SUMMARY OF THE INVENTION

A machine for making toy sparklers or the like includes a machine frame having a tabletop and a casing disposed on the tabletop. Partitions divide the casing into a plurality of subdivisions in which sparkler sticks are disposed. Frame means having a plurality of subdivisions are mounted above the casing and vibrating means are operatively connected to the frame means for vibrating the latter. The tabletop has a plurality of depressions with a through hole being located centrally of each depression. Each of the holes is of a size to accommodate one stick. The tabletop has a raised edge surrounding each of the holes. A receiving plate is located below the tabletop and is arranged such that the sticks passing through the holes in the tabletop have their bottom ends abutting the receiving plate. Support means are disposed above the receiving plate and are adapted to accommodate an insertion plate in which the sparkle sticks are inserted. Operable means are provided to raise and lower the receiving plate and the insertion plate.

DESCRIPTION OF THE PREFERRED EMBODIMENTS

Figure 1:
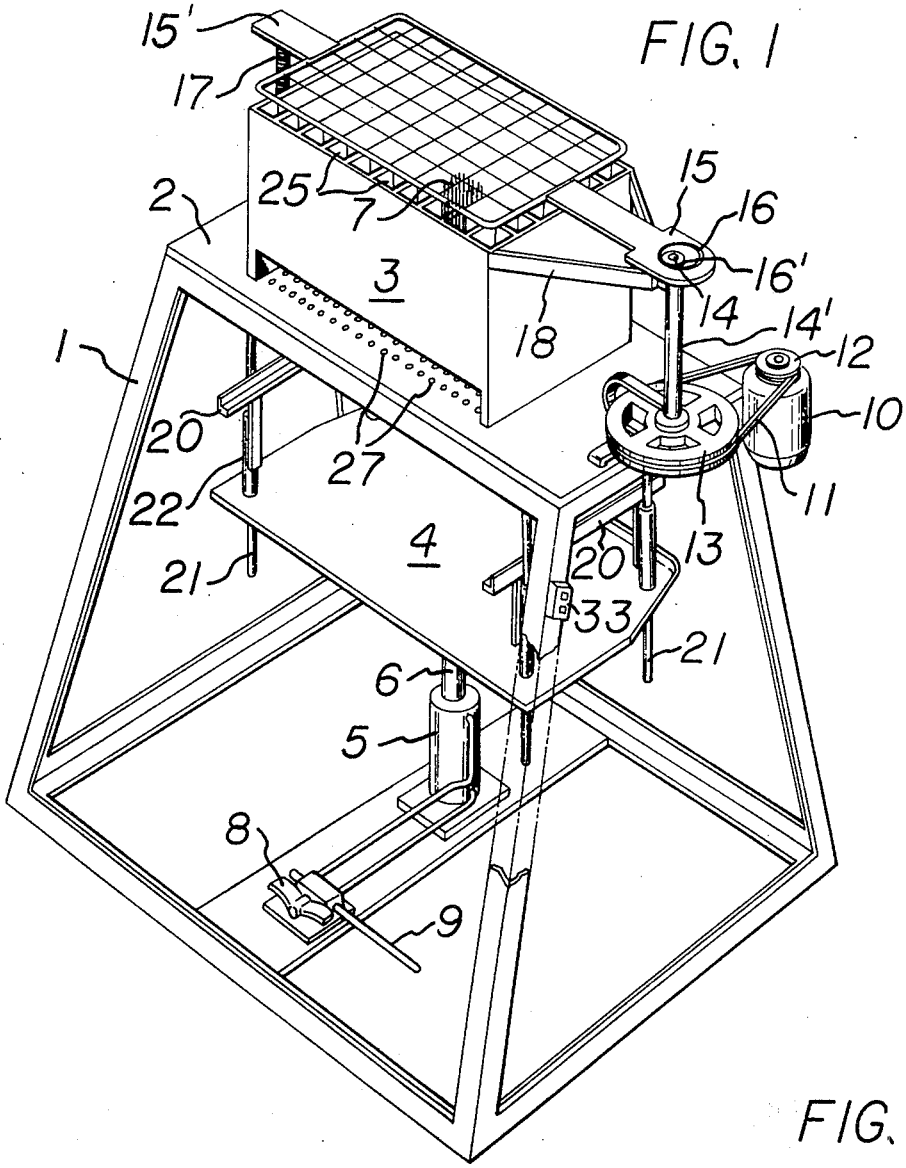
FIG. 1 is a perspective view of a machine for making fireworks according to one embodiment of the invention.

Referring to the drawings, a machine according to one embodiment of the present invention includes a stick charging casing 3 divided into subdivisions 25 by the partition walls 23, 26. The casing 3 is disposed on a table 2 which forms the upper part of a machine frame 1. A plurality of circular depressions 27, as will be described in greater detail hereinafter, are arranged in a regular manner on the upper surface of the table 2 under the casing 3. A frame 18 is fixed to the casing 3 and is rigidly fixed to a sleeve 14' which surrounds a shaft 14. The shaft 14 is driven by a motor 10 through a belt 11 and wheels or pulleys 12, 13. Supported on the top of the sleeve 14' is a shank 15 having a link 16 and in which a roller 16' provided at the top of and secured to the shaft 14 is eccentrically engaged. The shank 15 is secured to a framed net 24. Another shank 15' at the other side of the framed net 24 is supported by the tip of a coil spring 17 surrounding a vertical rod in such a manner that the frame net 24 is supported to move or swing.

Figure 2:
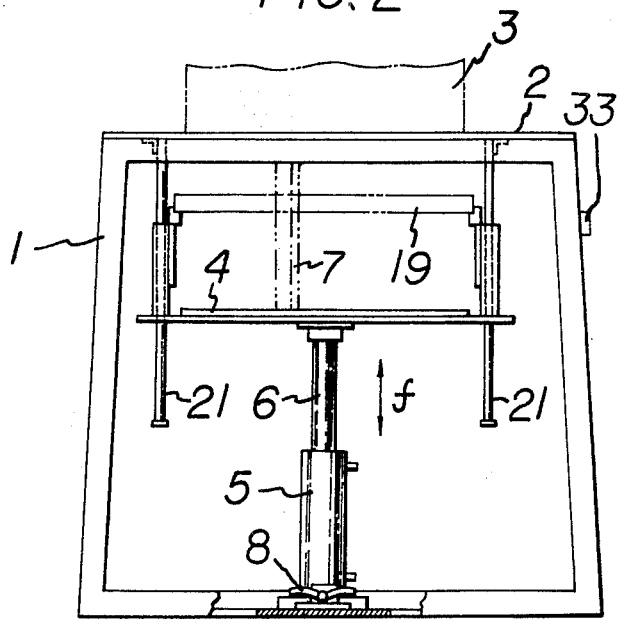
FIG. 2 is a front view of the lower part of the machine shown in FIG. 1.

A stopping or receiving plate 4 which is mounted to ascend and descend alternatively in parallel with the table 2 along vertical guides 21. The plate 4 moves in the direction indicated by the arrow *f* in FIG. 2 by means fo a cylinder 5 and piston 6 operated under air pressure supplied through a pipe 9 and controlled by a pedal 8 which may be inclined to the right or left to control the air flow.

A pair of horizontal guides 20 are fixedly mounted between sleeves 22 on the plate 4 and which slide along the guides 21. The guides 20 support a horizontally disposed stick inserting plate means 19 (FIG. 2) which, in the upper movement of the plate 4, contacts the lower surface of the table 2 so as to communicate a central hole 31 in the depressions 27 to the openings arranged regularly in the plate means 19. The stick inserting plate means 19 which may actually consist of three plates disposed one over the other in layers and arranged so as to communicated or align the openings in each plate with each other may be inserted in the machine such that the sticks pass into the aligned openings therein one by one. Thereafter the middle plate between the upper and lower plates may be moved or slid relative to the other two plates to thereby fix the sticks in position on the plate means 9.

Figure 6:
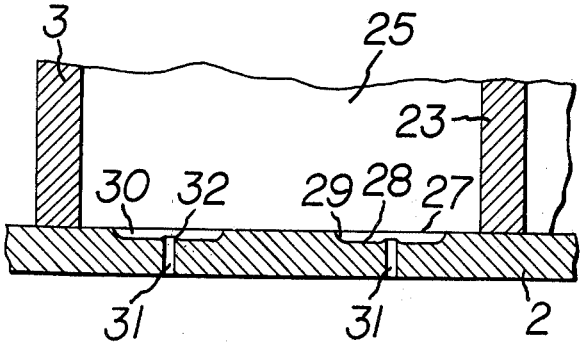
FIG. 6 is a partial sectional view taken along the line 6—6 in FIG. 5.

A plurality of sticks 7 which are to form the sparklers are arranged in a standing disposition in the casing 3 and protrude through the subdivision openings 25 formed by the partition walls 23, 26. In FIG. 1 the sticks 7 are shown in only one subdivision opening 25 for illustrative purposes but it will be understood that the sticks 7 may be included in all of the subdivision openings 25. Under each subdivision 25 in the casing 3, there are provided four depressions 27 on the upper surface of the table 2, and each depression 27 consists of a cavity 30 and a central, single hole 31 which is surrounded by a raised circular edge 32. The raised circular edge 32 is slightly higher than the bottom 28 of the depression 27 as shown in FIG. 6. Generally the sticks 7 in the casing 3 stand within the depressions 27 but when the frame net 24 is vibrated by means of the motor 10 and eccentric connection previously described, the sticks 7 are moved to thereby be inserted into the holes 31 one by one and pass into the openings in the plate means 19, to rest at their lower ends on the receiving plate 4. The raised edge 32 on the table 2 prevents the simultaneous insertion of two or more sticks in a single hole 31 as not to clog the hole 31 or to not separate the inserted sticks 7 from the plate means 19.

Figure 3:
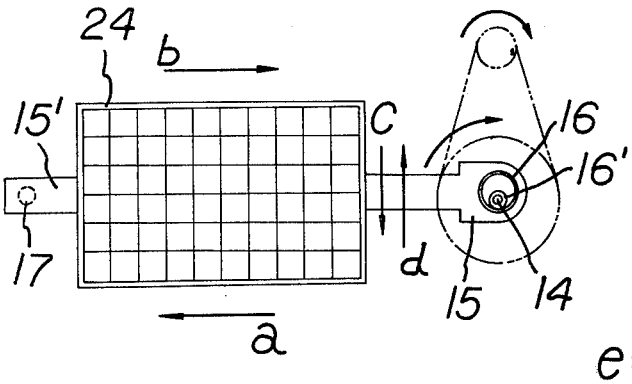
FIG. 3 is a plan view showing the framed net and the vibration device for vibrating the framed net.
Figure 4:
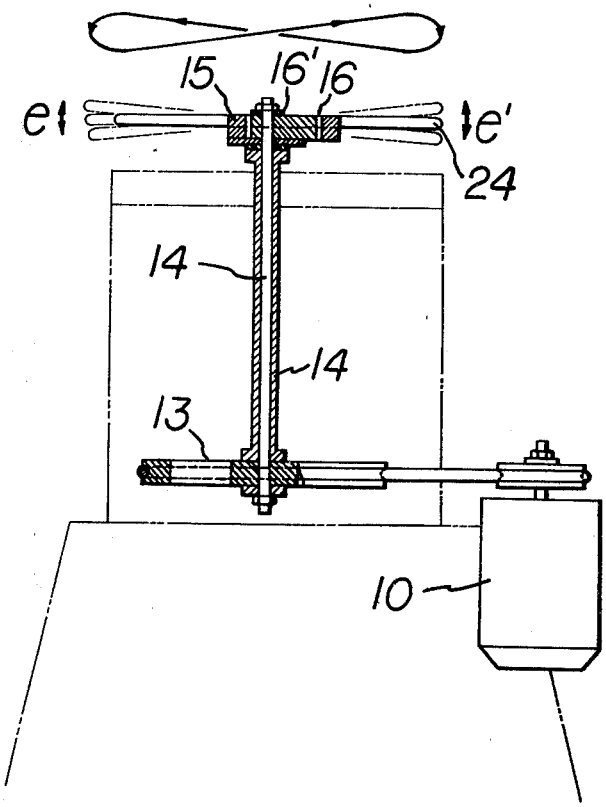
FIG. 4 is an elevational view, partly in section, of the eccentric drive arrangement.
Figure 5:
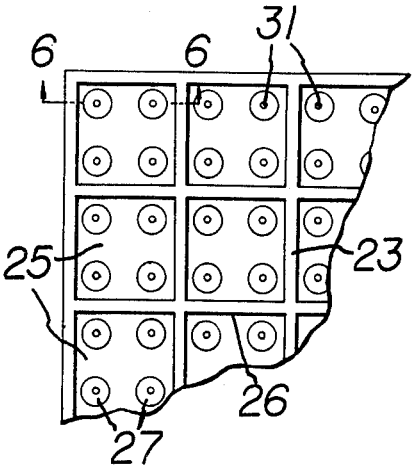
FIG. 5 is a partial plan view of the casing in which the sparkler sticks are disposed.

The machine according to the present invention has its motor 10 connected to an electric source and also has the air supplying pipe 9 connected to an air compressor (not shown). The roller 16' provided at the top of the shaft 14 and which is rotated by means of the motor 10, belt 11, and wheels or pulleys 12, 13, eccentrically contacts the edge of the link 16 in the shank 15 as to vibrate the net 24 in the multiple directions indicated by references *a, b, c, d, e, e'* in FIGS. 3 and 4. The vibration in the various directions, that is, horizontal, vertical, inclined, etc., imparts shocks or pulses to the sticks 7 at their upper ends so as to make their lower ends move over the raised edge 32 into the hole 31. The shocks effected by the vibration may be controlled with a switch 33 mounted on the machine frame 1 and may be stopped after the sticks 7 and inserted completely in the regular openings of the plate means 19.

The plate means 19 containing the inserted sticks 7 is taken off or slid out from the guides 20 when the plate means 19 descends together with the plate 4. Then the lower end of the sticks 7 arranged regularly in the plate means 19 may be carried to sink or be dipped simultaneously into the paste of gunpowder or other powder within a vessel to thereby form sparklers. It is thought that the invention and many of its attendant advantages will be understood from the foreqoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A machine for use in making toy sparklers comprising a machine frame having a tabletop, a casing disposed on said tabletop, partitions dividing said casing into a plurality of subdivisions in which sparkler sticks are disposed, frame means having a plurality of subdivisions mounted above said casing, vibrating means operatively connected to said frame means for vibrating the latter, said tabletop having a plurality of depressions with a through hole being located centrally of each depression, each of said holes being of a size to accommodate one stick, said tabletop having a raised edge surrounding each of said holes, a receiving plate located below said tabletop and arranged such that the sticks passing through said holes have their bottom ends abutting said receiving plate, support means disposed above said receiving plate and adapted to accommodate an insertion plate in which said sparkler sticks are inserted, and operable means to raise and lower said receiving plate and said insertion plate.

2. A machine according to claim 1 wherein said raised edges surrounding said holes are disposed within said depressions and below the upper surface of said tabletop.

3. A machine according to claim 1 wherein said frame means includes two shanks, one of said shanks being resiliently supported by a spring means.

4. A machine according to claim 3 wherein the other of said shanks is operatively connected to an eccentric roller, and motor means mounted on said machine frame for driving said eccentric roller.

5. A machine according to claim 1 wherein said support means extends between said insertion plate and said receiving plate such that said insertion plate and receiving plate are raised and lowered together by said operable means.

6. A machine according to claim 1 wherein said frame means comprises a net-like structure having a plurality of openings corresponding to the subdivisions in said casing.

7. A machine according to claim 1 wherein said vibrating means is operable to vibrate said frame means in a plurality of directions.

* * * * *